United States Patent [19]

Schwartz

[11] 4,091,586

[45] May 30, 1978

[54] MOLDING

[76] Inventor: David O. Schwartz, 244 Fairhaven Blvd., Woodbury, N.Y. 11797

[21] Appl. No.: 814,533

[22] Filed: July 11, 1977

[51] Int. Cl.[2] ..... A47K 3/16; E04F 19/04

[52] U.S. Cl. ..... 52/287; 52/35; 52/288; 52/716

[58] Field of Search ..... 52/288, 290, 716, 717, 52/718, 169.5, 169.14, 179, 211, 241, 312, 511, 512, 469, 466, 462, 277, 275, 278, 630, 27, 273, 287, 35, 34, 276, 264, 247, 302; 49/475

[56] References Cited

U.S. PATENT DOCUMENTS

| | | | |
|---|---|---|---|
| 2,222,908 | 11/1940 | King | 52/302 X |
| 2,343,201 | 2/1944 | Nilson | 52/264 |
| 2,968,263 | 1/1961 | Huston et al. | 52/302 X |
| 3,344,569 | 10/1967 | Cotten | 52/287 |
| 3,616,587 | 11/1971 | Schlafly, Jr. | 52/288 |

FOREIGN PATENT DOCUMENTS

| | | | |
|---|---|---|---|
| 2,361,285 | 6/1975 | Germany | 52/288 |
| 1,912,683 | 10/1970 | Germany | 52/288 |

*Primary Examiner*—Alfred C. Perham
*Attorney, Agent, or Firm*—Robert E. Isner

[57] ABSTRACT

A water tight molding for sealing and protecting a joint formed by the intersection of two surfaces. An underlying molding piece spans the joint and is adhesively attached to the two surfaces in a water tight manner. An outer molding piece is held in spaced relation to the underlying piece by spaced apart connecting members. The outer molding piece prevents water from directly acting on the joint. The underlying molding piece directs water draining from one surface away from the joint downwardly to the other surface.

3 Claims, 1 Drawing Figure

MOLDING

BACKGROUND OF THE INVENTION

The present invention relates to molding or sealing strips and in particular to a molding for installation at the juncture of two surfaces.

In bathrooms or shower rooms, for example, where bath tubs or showers are joined to an adjacent wall, there is a crack at the intersection where water may enter and cause deterioration. Commonly this crack is filled with a caulking compound to prevent seepage. The caulking is then either used alone or is covered with a decorative molding.

The action of shower water on this joint, the movement of a person in the tub or shower and differences in expansion and contraction of the tub or shower and the adjacent wall with temperature cause the caulking to loosen and deteriorate with time. The caulking becomes less effective in keeping water out of the joint and becomes unsightly as cracks develop between the caulking and the adjacent surfaces wherein dirt and scum are collected.

When conventional moldings have been used, there has been only moderate success in alleviating this unsightly appearance.

SUMMARY OF THE INVENTION

The present invention overcomes the disadvantages of conventional moldings by providing structure for controlling water run-off and preventing, for example, shower water from directly acting upon the joint between the shower and the adjoining walls. Furthermore, the present invention provides an attractive molding that hides this joint and eliminates the need for caulking.

This is accomplished by providing a longitudinal underlying member with depending longitudinal members adhesively attached in a water tight manner to a vertical wall and horizontal surface spanning the joint formed by the intersection of the vertical wall and horizontal surface. An outer longitudinal member is held in spaced relation with the longitudinal underlying member by spaced apart connecting members. The outer longitudinal member prevents the water from directly reaching the joint and the underlying member directs any water draining from the wall downwards through the defined channels between the connecting members to the horizontal surface away from the joint.

BRIEF DESCRIPTION OF THE DRAWINGS

In order that the invention may be clearly understood and readily carried into effect, an embodiment will now be described, by way of example only, with reference to the accompanying drawing wherein.

DESCRIPTION OF A PREFERRED EMBODIMENT

Figure 1:
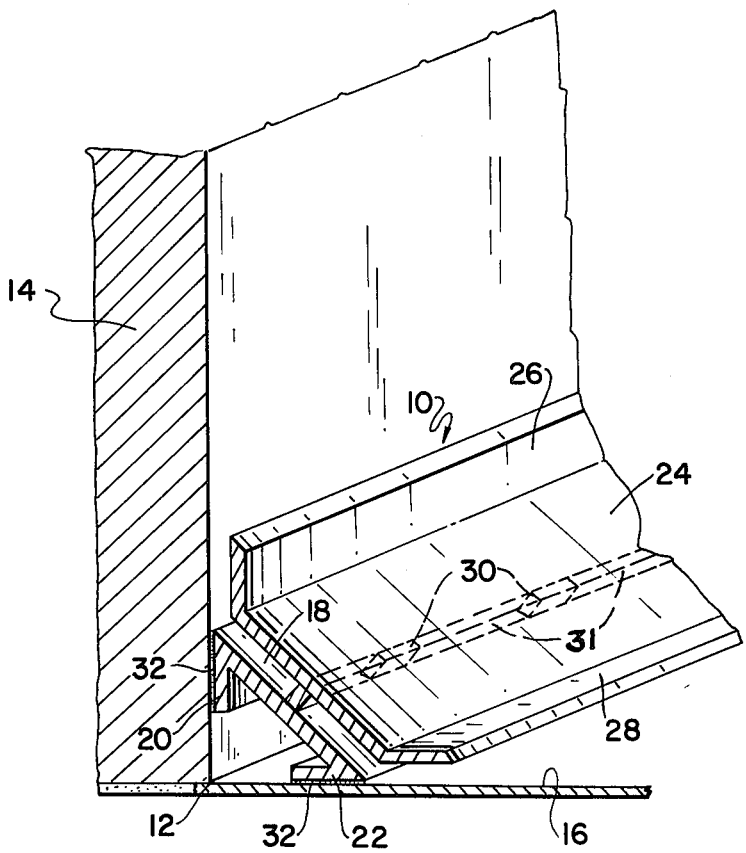
FIG. 1 is a perspective view partially in section showing the present invention joining two surfaces.

In FIG. 1, the molding 10 is shown mounted spanning a joint 12 between vertical wall 14 and horizontal surface 16.

The molding 10 is preferably constructed of plastic or vinyl material and includes a longitudinal underlying member 18. Depending from the longitudinal edges of the underlying member 18 in a direction toward the longitudinal axis of such member 18 are two longitudinal support flanges 20 and 22 forming approximately a 45° angle between each of the support elements 20 and 22 and the longitudinal underlying member 18 as shown in FIG. 1.

An outer longitudinal member 24 has two longitudinal flanges 26 and 28 projecting from the longitudinal edges of such member 24 in a direction outwardly from the axis of the outer longitudinal member 24 at approximately 45° to the outer longitudinal member 24. This outer longitudinal member 24 is held in spaced relation with the underlying longitudinal member 18 by a series of spaced apart connecting members 30 along the longitudinal axes of both the underlying longitudinal member 18 and the outer longitudinal member 24. The spaced apart connecting members 30 form a series of channels 31 through which fluid may pass between the underlying longitudinal member 18 and the outer longitudinal member 24.

When the molding 10 is positioned to span across the joint 12, as shown in FIG. 1, the projecting flanges 26 and 28 are parallel to the vertical wall 14 and the horizontal surface 16 respectively. The outer longitudinal member 24 and the projecting flanges 26 and 28 are sized such that when the molding 10 is positioned across the joint 12, the projecting flanges 26 and 28 are held away from the vertical wall 14 and the horizontal surface 16 respectively.

The molding 10 is attached to the vertical wall 14 and the horizontal surface 16 with mounting adhesive tape 32 affixed to the support flanges 20 and 22. Preferably this mounting tape 32 is a composite tape having a foam center and a layer of permanent bonding adhesive on both opposing faces and known in the trade as double coated foam tapes.

When the molding 10 is positioned to span the joint 12 and pressed against the vertical wall 14 and horizontal surface 16, the molding 10 is held by the mounting tape 32 to the vertical wall 14 and horizontal surface 16. This adhesive attachment creates a water tight joint eliminating the need for caulking material.

When the molding 10 is in place, the outer longitudinal member 24 protects the joint 12 from direct action of water coming, for example, from a shower head. Any water which drains down the vertical wall 14 will be directed downwardly through the channel 31 between the connecting members 30 to the horizontal surfaces 16 and away from the joint 12.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

I claim:

1. A molding for protecting and sealing a joint formed by the intersection of two surfaces from a fluid comprising:

an underlying longitudinal member;

means for affixing one longitudinal edge of the underlying longitudinal member to one of the two surfaces and means for affixing the other longitudinal edge of the underlying longitudinal member to the other of the two surfaces whereby the underlying longitudinal member spans the longitudinal joint;

an outer longitudinal member; and spaced apart connecting members holding the outer longitudinal member spaced apart relation with the underlying longitudinal member and defining at least one channel through which the fluid may flow downwardly between the outer longitudinal member and the underlying longitudinal member away from the joint;

the outer longitudinal member being sized to substantially cover the underlying longitudinal member when the molding is mounted to span the joint which each longitudinal edge of the outer longitudinal member is spaced apart from the surface adjacent their respective edge.

2. A molding for protecting and sealing a joint formed by the intersection of a vertical wall and a horizontal surface from a fluid comprising;

an underlying longitudinal member having upper and lower longitudinal flanges integrally formed on opposite longitudinal edges of the underlying longitudinal member and depending therefrom at approximately 45° with the underlying longitudinal member toward the longitudinal axis of the underlying longitudinal member;

an outer longitudinal member;

spaced apart connecting members for holding the outer longitudinal member in spaced apart relation with the underlying longitudinal member and defining a multitude of channels through which the fluid may flow downwardly between the underlying longitudinal member and the outer longitudinal member away from the joint; and means affixed to the outer surface of the upper and lower longitudinal flanges integrally formed on the underlying longitudinal member for mounting the molding to span the joint such that the upper longitudinal flange is mounted to the vertical wall and the lower longitudinal flange is mounted to the horizontal surface;

the outer longitudinal member being sized to substantially cover the underlying longitudinal member when the molding is mounted to span the joint and being spaced apart from the vertical wall and horizontal surface.

3. The molding according to claim 2 wherein the outer longitudinal member includes upper and lower longitudinal flanges integrally formed on opposite longitudinal edges of the outer longitudinal member and projecting therefrom at approximately 45° in a direction away from the axis of the longitudinal outer member.

* * * * *